United States Patent [19]

Williams

[11] 4,146,994

[45] Apr. 3, 1979

[54] DOOR HAVING IMPROVED CLOSING AND LATCHING SYSTEMS

[76] Inventor: Clarence E. Williams, 2122 W. 450 N, LaPorte, Ind. 46350

[21] Appl. No.: 868,905

[22] Filed: Jan. 12, 1978

Related U.S. Application Data

[63] Continuation-in-part of Ser. No. 757,979, Jan. 10, 1977, abandoned.

[51] Int. Cl.[2] ..... E05C 7/05

[52] U.S. Cl. ..... 49/367; 49/7; 49/379; 49/386; 49/395

[58] Field of Search ..... 49/366, 367, 368, 369, 49/394, 395, 379, 386, 7, 8; 292/332, 40, 7

[56] References Cited

U.S. PATENT DOCUMENTS

| | | | |
|---|---|---|---|
| 1,184,919 | 5/1916 | Bock | 292/332 UX |
| 1,515,612 | 11/1924 | O'Connor | 292/332 X |
| 1,870,746 | 8/1932 | Pyle | 292/332 X |
| 2,015,996 | 10/1935 | Eichacker | 49/366 |
| 2,711,565 | 6/1955 | Levin | 4.9/395 X |
| 3,023,068 | 2/1962 | Haag | 49/369 X |
| 3,038,569 | 6/1962 | Knox | 49/7 X |
| 3,403,954 | 10/1968 | Williams | 49/7 X |
| 3,777,423 | 12/1973 | Coulter et al. | 49/379 X |
| 3,792,556 | 2/1974 | Anghinetti et al. | 49/379 X |
| 3,895,461 | 7/1975 | Maynard, Jr. et al. | 49/367 |

*Primary Examiner*—Philip C. Kannan

*Attorney, Agent, or Firm*—Oltsch, Knoblock & Hall

[57] ABSTRACT

A pair of doors hinged to a frame and including a self-locking three-point latch and coordinated closing system.

6 Claims, 25 Drawing Figures

Fig. 13
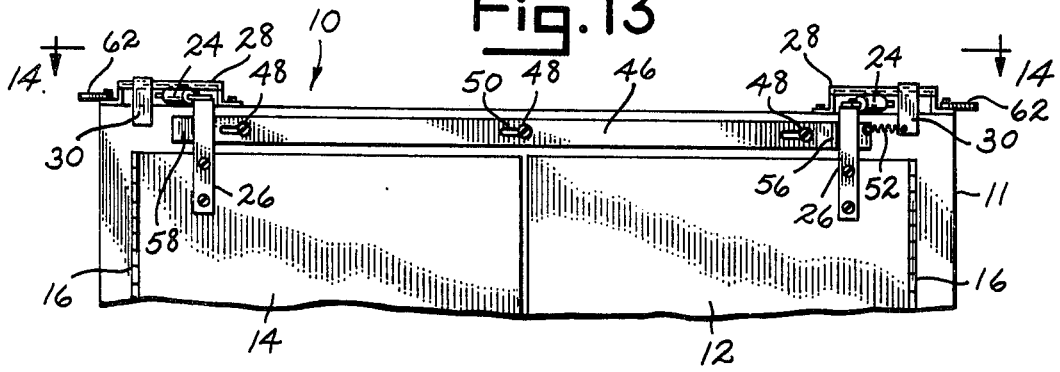
Fig. 14
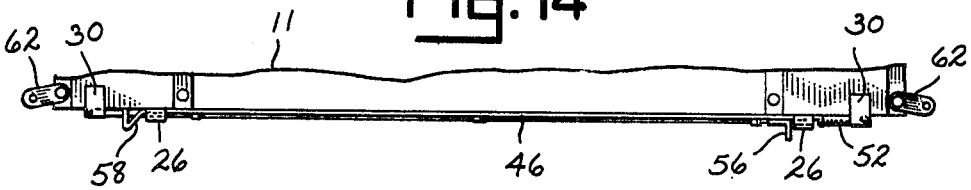
Fig. 15
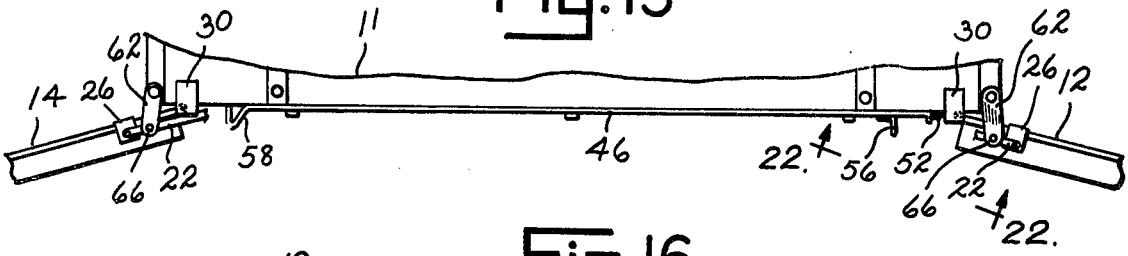
Fig. 16
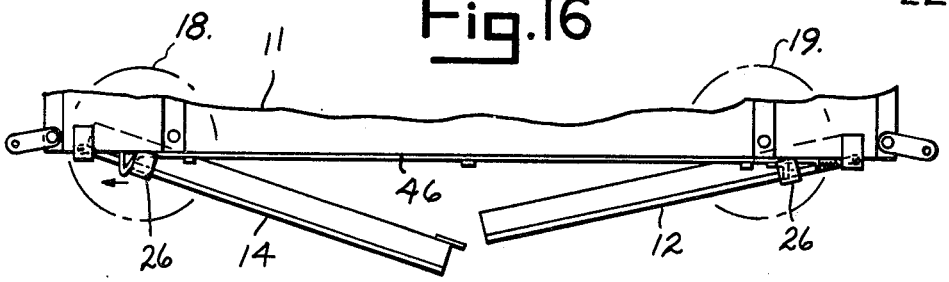
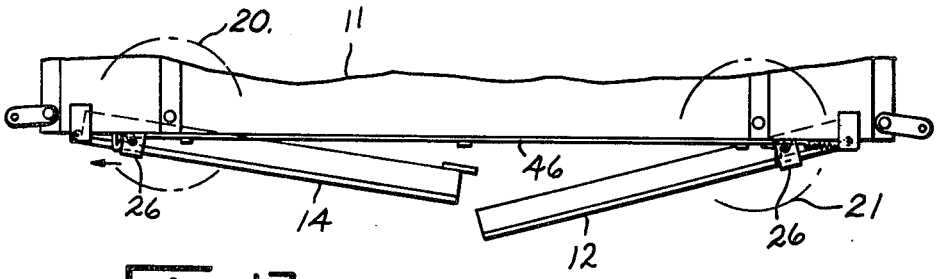
Fig. 17

Fig. 23
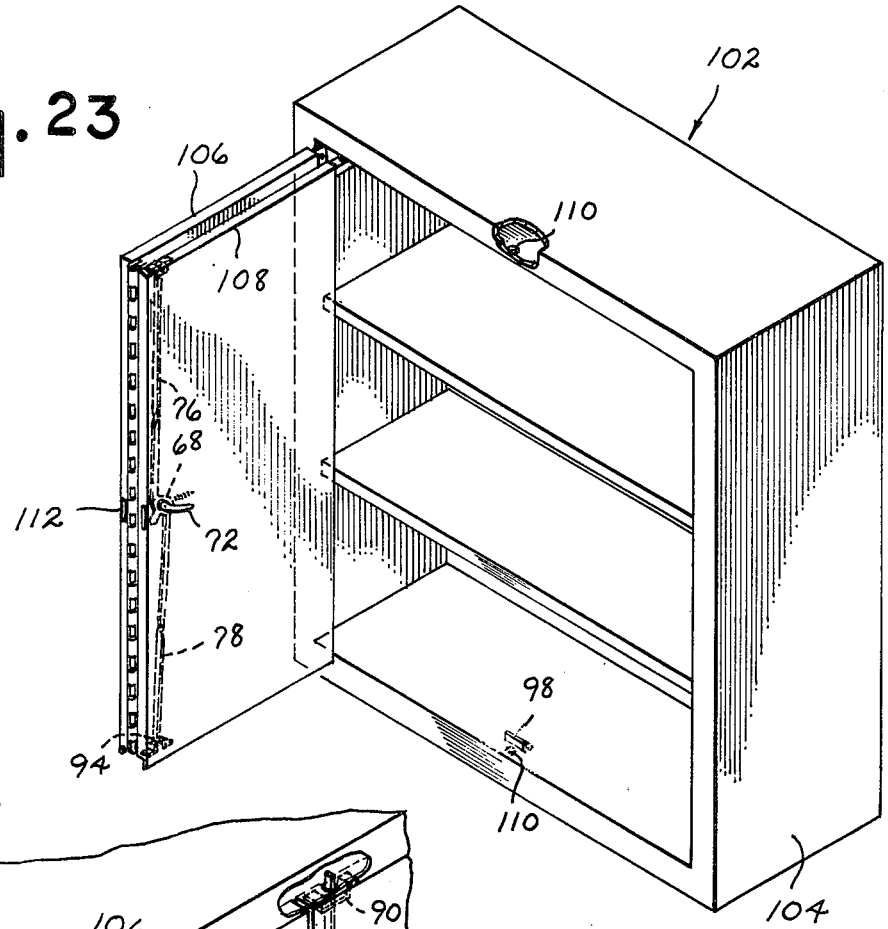
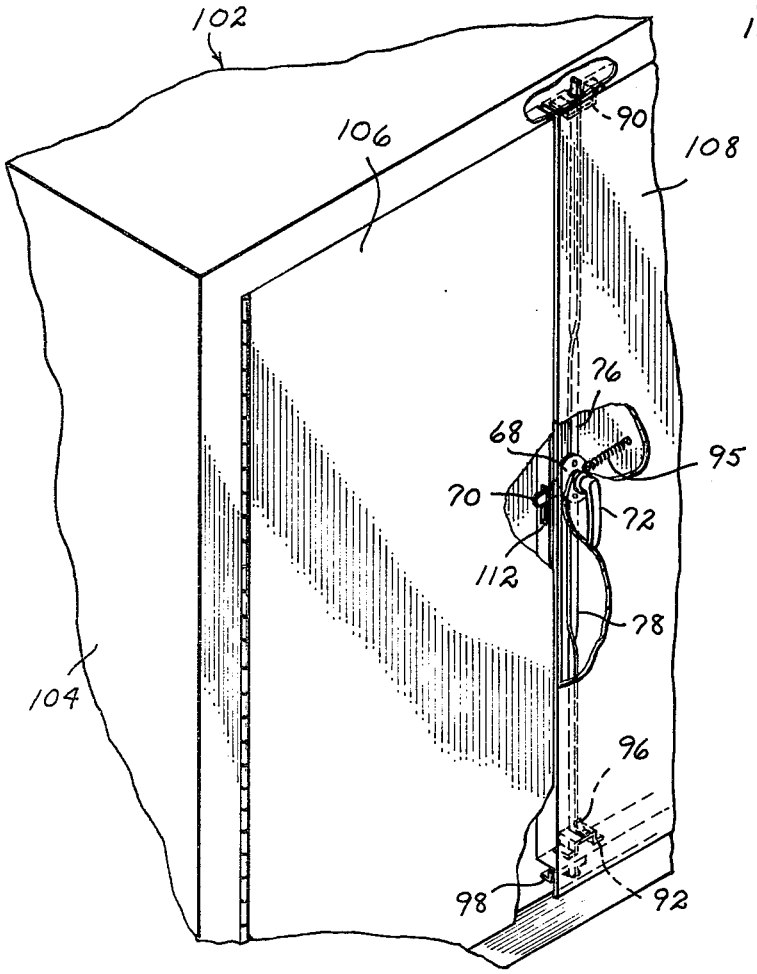
Fig. 24

DOOR HAVING IMPROVED CLOSING AND LATCHING SYSTEMS

CROSS-REFERENCE TO RELATED APPLICATION

This is a continuation-in-part of application Ser. No. 757,979, filed Jan. 10, 1977 and abandoned.

SUMMARY OF THE INVENTION

This invention relates to a door construction which has a coordinated latching and closing system and which will have specific but not limited application to storage cabinets in which the hinged pair of doors thereof will close and latch coordinatively.

In this invention the hinged doors are provided with a three-point latching mechanism which will automatically secure the doors when the doors are closed by spring urged or similar biasing means. A prop mechanism serves to coordinate the closing movement of the doors so as to assure their securement by the latching mechanism.

If the door construction of this invention is utilized in association with a metal storage cabinet for storage of paints, lacquers and similar flammable materials the doors of the cabinet may be secured in their open positions by heat fusible links. When the cabinet is subjected to an abnormal amount of heat, such as would occur in the presence of a fire, the fusible links will melt releasing the doors which are self closed and securely latched.

It is an object of this invention to provide a pair of frame-hung doors having a self-closing and self-latching function.

It is another object of this invention to provide a pair of self-closing doors having a coordinated self-securing three-point latching system.

Still another object of this invention is to provide an economical coordinated closing system for overlapping, hinged doors.

And still another object of this invention is to provide a self-closing and latching door construction for cabinets.

Other objects of this invention will become apparent upon a reading of the invention's following description.

BRIEF DESCRIPTION OF THE DRAWINGS

FIG. 13 is a front view of the upper portion of the cabinet illustrating an alternative embodiment of the self-closing system for the cabinet doors.

FIG. 14 is a fragmentary top plan view of the coordinated door closing system shown in FIG. 13.

FIG. 15 is a fragmentary top plan view of the coordinated door closing system of FIG. 13 showing the cabinet doors thereof secured in their full open positions.

FIGS. 16 and 17 are top plan views of the coordinated door closing system shown in FIG. 13 with the doors thereof in sequential closing positions.

FIG. 23 is a perspective view of a cabinet of modified construction utilizing the door latching system of this invention and having its doors in their open position.

FIG. 24 is a perspective view of the cabinet of FIG. 23 shown with its doors closed and having portions thereof broken away for purposes of illustration.

DESCRIPTION OF THE PREFERRED EMBODIMENTS

The preferred embodiments illustrated are not intended to be exhaustive or to limit the invention to the precise forms disclosed. They are chosen and described in order to best explain the principles of the invention and its application and practical use to thereby enable others skilled in the art to best utilize the invention.

Figure 1:
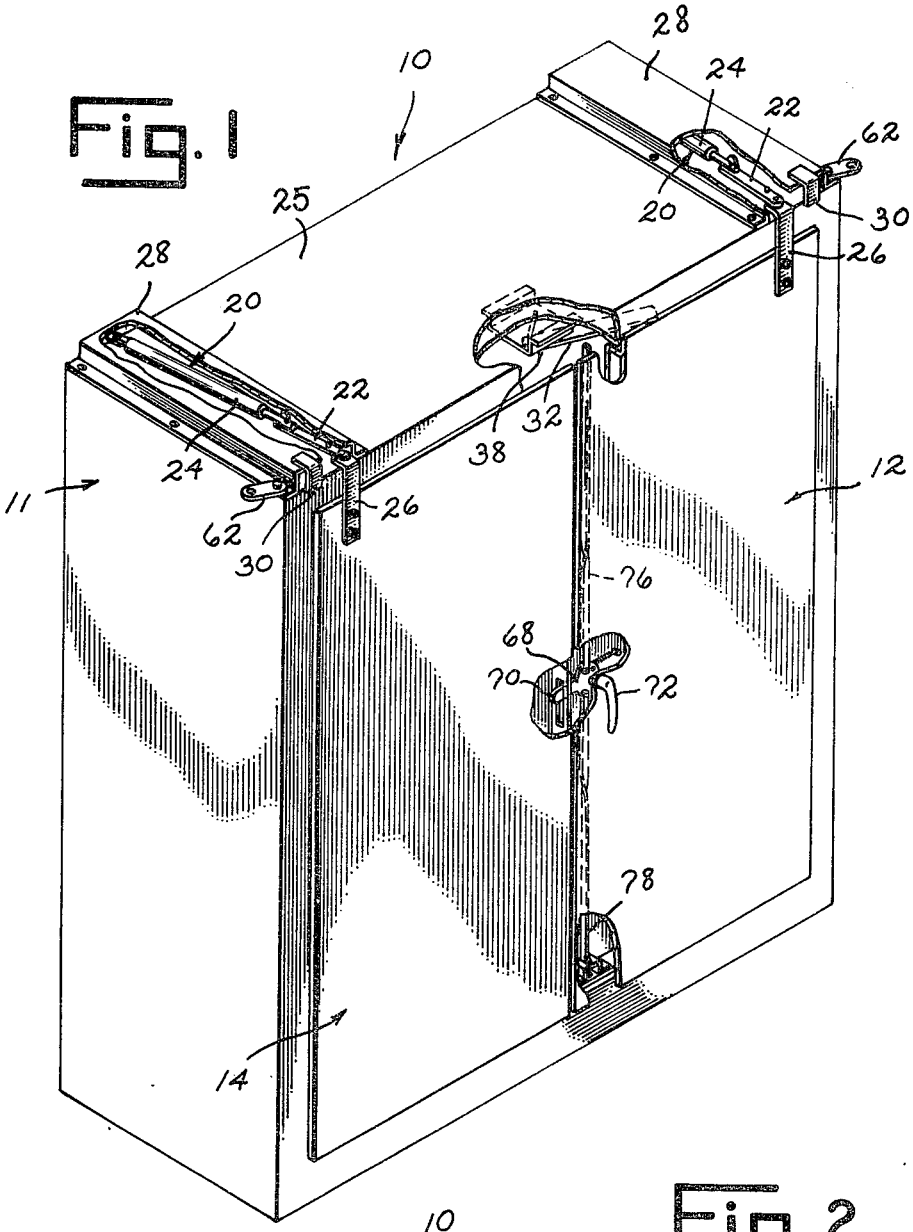
FIG. 1 is a perspective view of a cabinet illustrating one embodiment of the coordinated self-closing and latching door system with portions of the cabinet broken away for purposes of illustration.
Figure 2:
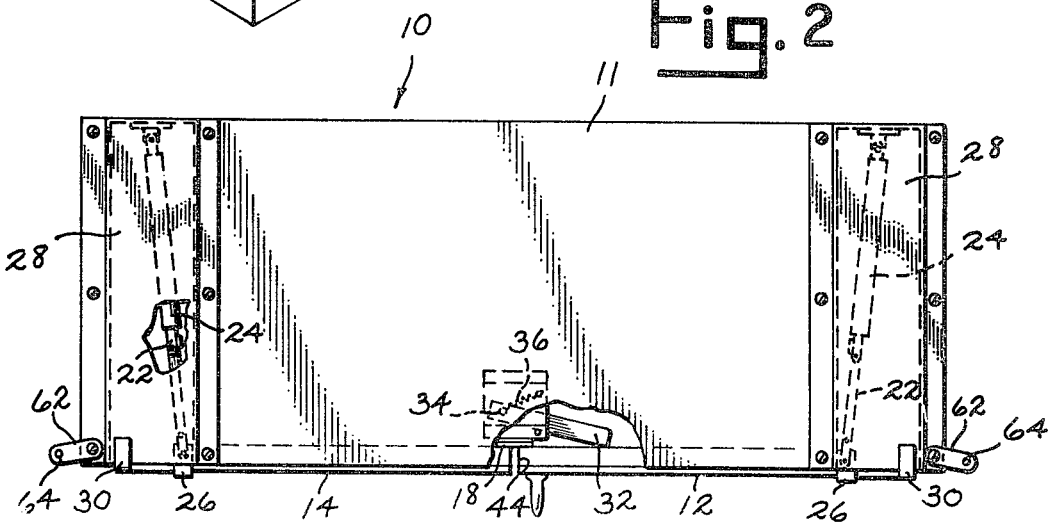
FIG. 2 is a top plan view of the cabinet of FIG. 1 showing portions of the cabinet broken away for purposes of illustration.

Cabinet 10 illustrated in FIG. 1 includes a housing 11 having a framed front opening spanned by a pair of doors 12 and 14. Doors 12 and 14 are each suitably hinged at 16 to cabinet 10. Door 14 carries a lip 18 which extends along the door's free side edge 19 and which is overlapped as illustrated in FIG. 2 by door 12 when the doors are in their closed positions. Housing 11 and doors 12 and 14 of cabinet 10, if the cabinet is to be utilized as a storage facility for flammable liquids, may be formed of sandwiched heavy sheet steel construction and insulated.

A spring-actuated closure 20 is secured between housing 11 and each of the doors 12 and 14. A segmented actuator rod 22 projects from cylinder 24 of each closure 20. Each closure 20 has its cylinder 24 pivotally anchored to the top 25 of cabinet housing 11. Segmented rod 22 of each closure 20 is connected to a bracket 26 which is in turn secured to each of the doors 12 and 14. A cover 28 extends over each closure 20 with actuator rod 22 of the enclosed closure protruding from the front open end of the cover. Each cover 28 carries a stop 30 which is located above but in general alignment with the hinged pivot axis of the underlying door 12, 14. A spring (not shown) is located within each closure cylinder 24 between the rod 22 of the cylinder and the cylinder itself. As either door 12 or 14 is opened, rod 22 of the door's closure 20 is extended and pivoted about adjacent stop 30 to cause the compression of the spring within the closure cylinder. As the door is released, the spring will cause the retraction of the closure actuator rod 22 which is pivotally cammed about contacting stop 30 to automatically close the door. The speed at which each closure 20 closes its door 12 or 14 is regulated by a hydraulic or pneumatic regulator commonly utilized in door closures.

Figure 7:
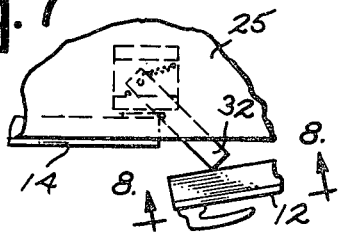

The sequential closing of doors 12 and 14 through closures 20 is effected in the embodiment of the cabinet illustrated in FIGS. 1–7 by a prop 32. Prop 32 is pivotally connected at 34 to the top 25 of cabinet housing 11 within the interior of the housing approximately midway between doors 12 and 14 and near the door opening into the housing. A helical spring 36 is connected between housing 11 and prop 32 at a location spaced from its pivot point 34 so as to cause the prop to be normally urged into the angled protruding position illustrated in FIGS. 3 and 4. Prop 32 is retained in its protruding position, angled slightly toward door 12, by means of stop pin 38 which is carried by top 25 of cabinet housing 11. Lip 18 of door 14 is inset from the upper edge of the door so as to permit door 14 to be drawn by its closure 20 into the partly closed position shown in FIG. 4, there first making contact as illustrated by broken lines 40 in FIG. 4 at edge 19 with prop 32. Should door 12 be drawn toward its closed position by its closure 20 ahead of door 14, door 12 will be caused to contact the end of prop 32 and be held in a partially closed position. Upon contact of door 14 at edge 19 with prop 32, door 14 will bypass the held, partially closed door 12 and cause the prop to be cammed or pivoted inwardly as illustrated sequentially in FIGS. 5–7. As door 14 is closed in abutment with cabinet housing 11, as illustrated in FIG. 7, prop 32 will be cammed sufficiently inwardly to allow door 12 under the urging of its closure 20 to complete its closing movement with the free edge 44 of door 12 overlapping lip 18 of door 14 as shown in FIGS. 1 and 2. In this manner prop 32 coordinates the closing movement of doors 12 and 14 with it being assured that door 14 with its underlying lip 18 will always be drawn into its closed position before door 12. Prop 32 will pivot into its full protruding position by the operation of spring 36 whenever doors 12 and 14 are opened.

A second embodiment for coordinating the closing of doors 12 and 14 of cabinet 10 is illustrated in FIGS. 13–22. A bar 46 is mounted to the front of cabinet housing 11 above doors 12 and 14. Bar 46 extends from adjacent the hinged pivot 16 of door 12 to adjacent the hinged pivot 16 of door 14 and is secured to housing 11 by screws 48 extending through elongated slots 50 in the bar. In this manner bar 46 is shiftable longitudinally relative to cabinet housing 11. A helical spring 52 is connected between stop 30 above door 12 and end 54 of bar 46. Bar 46 carries a protrusion part 56 which is inwardly spaced from its end 54 and in general alignment with bracket 26 of door 12. The opposite end of bar 46 is formed into an outturned bend to provide a camming surface 58. Camming surface 58 is in general alignment with bracket 26 of door 14.

Figure 18:
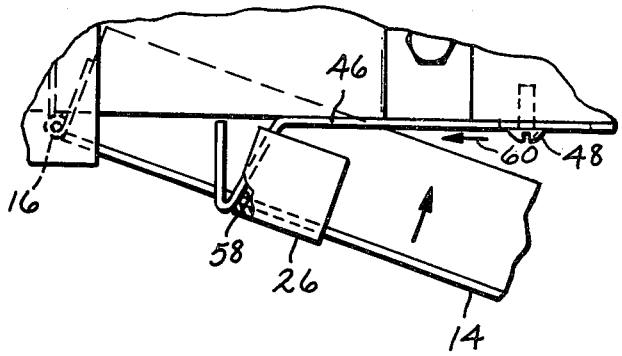
FIG. 18 is an enlarged detail view of that portion of the coordinated door closing system within broken line circle 18 of FIG. 16.
Figure 19:
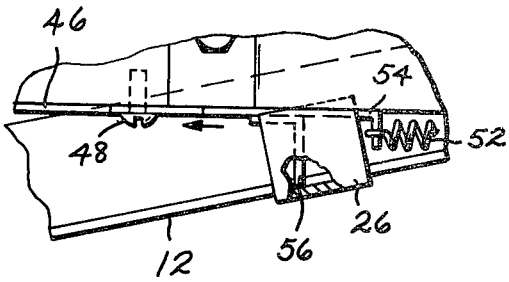
FIG. 19 is an enlarged detail view of that portion of the coordinated closing system within broken line circle 19 of FIG. 16.
Figure 20:
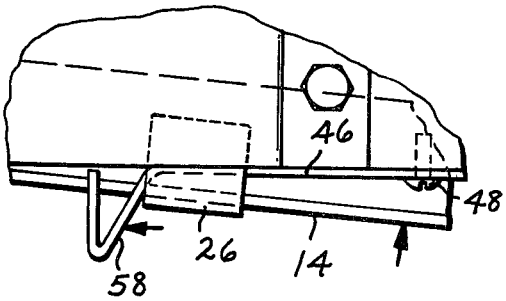
FIG. 20 is an enlarged detail view of that portion of the coordinated door closing system within broken line circle 20 in FIG. 17.
Figure 21:
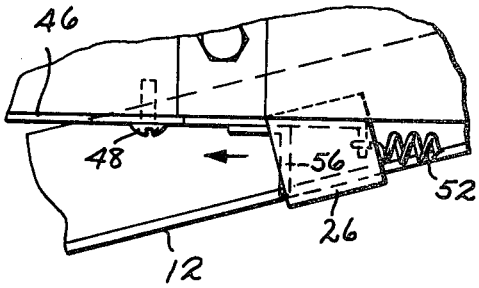
FIG. 21 is an enlarged detail view of that portion of the coordinated closing system within broken line circle 21 of FIG. 17.
Figure 22:
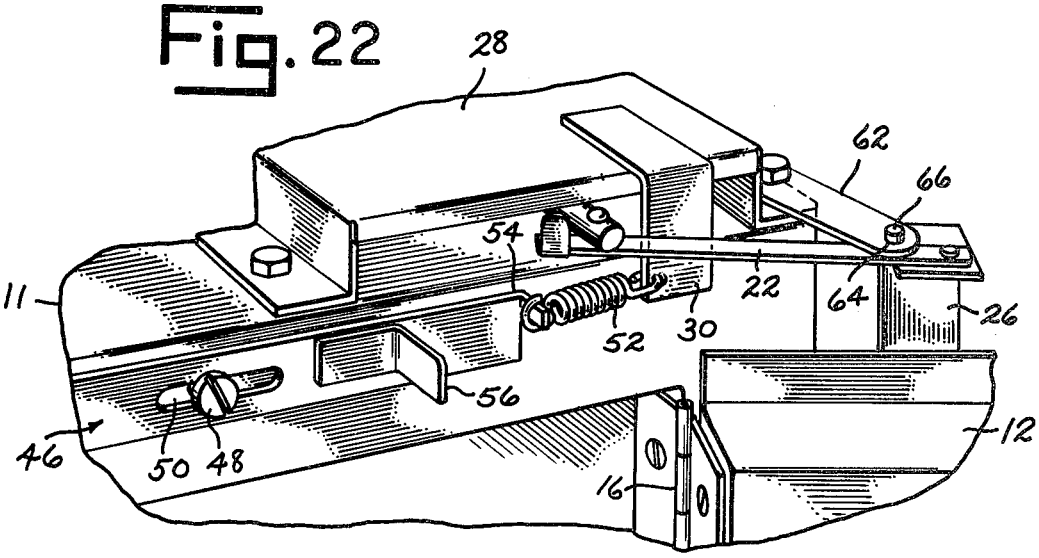
FIG. 22 is an enlarged detailed perspective view of that portion of the coordinated closing system as seen along line 22—22 of FIG. 15.

With doors 12 and 14 in their open positions as shown in FIG. 15, spring 52 will shift bar 46 toward door 12 until protrusion part 56 is aligned with bracket 26 associated with door 12. With bar 46 shifted toward door 12, the door will be held in a partially closed position as shown in FIGS. 16 and 19 through the abutment of protrusion part 56 with door-connected bracket 26. As door 14 is being drawn into its closed position by its closure 20, its connected bracket 26 will contact camming surface 58 as best illustrated in FIG. 18, causing bar 46 to be shifted toward door 14 as indicated by arrow 60. This movement of door 46 toward door 14 causes protrusion part 56 to become disengaged from bracket 26 connected to door 12 as illustrated in FIG. 21, thus allowing door 12 to close and overlap lip 18 of door 14. This sequential closing of doors 12 and 14 is illustrated in FIGS. 15–17. With doors 12 and 14 in their closed positions as illustrated in FIGS. 13 and 14, spring 52 will be extended in preparation for shifting bar 46 toward door 12 when the door is again opened.

Figure 3:
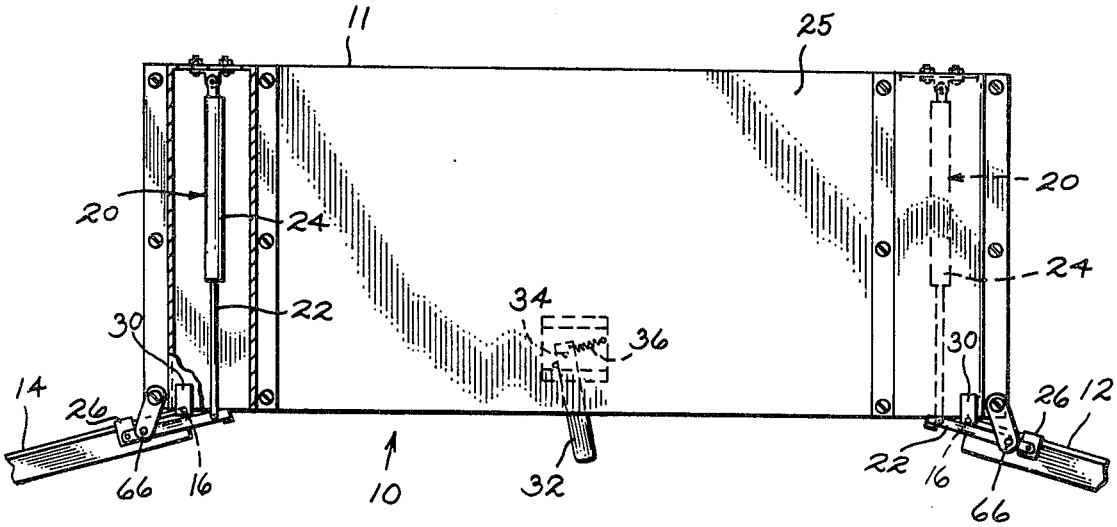
FIG. 3 is also a top plan view of the cabinet of FIG. 1 showing the doors of the cabinet secured in their open positions and again with portions of the cabinet broken away for purposes of illustration.
Figure 4:
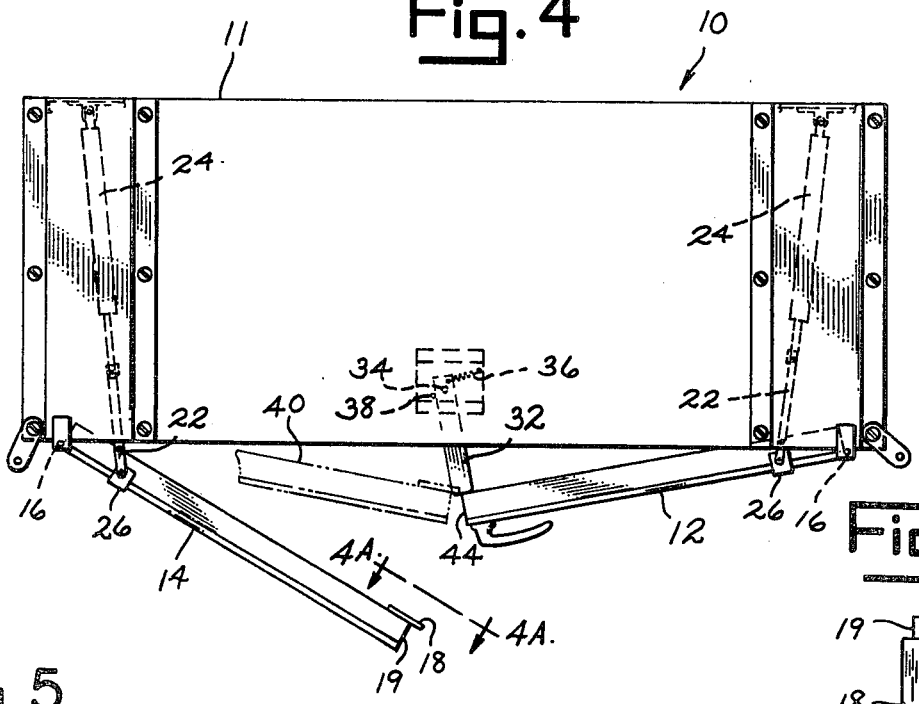
FIG. 4 is a top plan view of the cabinet of FIG. 1 showing the doors thereof in solid lines in an intermediate closing position and in broken lines in a secondary closing position.
Figure 4A:
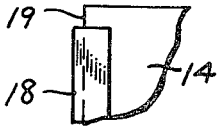
FIG. 4A is a fragmentary view of one door of the cabinet as seen from line 4A—4A of FIG. 4.
Figure 5:
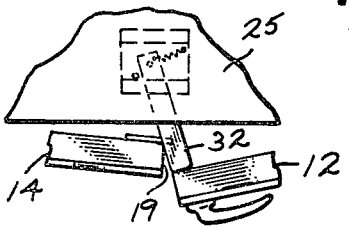
FIGS. 5–7 are fragmentary views of the cabinet showing the doors thereof in sequential closing positions.
Figure 6:
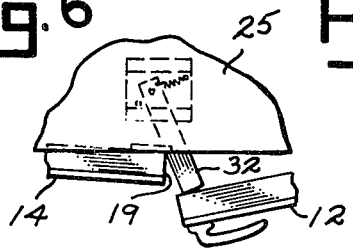

In the embodiment of cabinet 10 shown in FIGS. 1–7 and the embodiment of the cabinet shown in FIGS. 13–22, means are provided by which doors 12 and 14 may be secured in full open positions during cabinet usage. In the illustrated embodiments links 62 are connected between cabinet housing 11 and rods 22 of closures 20. One end of each link 62 is pivotally connected to cabinet housing 11 while the opposite end of the link is provided with an opening 64. This allows each link 62 to be pivotally moved and placed over a pin 66 connected to each closure rod 22 with the pin extending through opening 64 in the link as shown in FIGS. 3 and 15. To manually release doors 12 and 14 for closing, each link 62 need only be slipped upwardly off its engaging pin 66. If cabinet 10 in each of the illustrated embodiments is to be utilized as a safety cabinet for housing inflammable liquids or other materials, each link 62 may be of the fusible type which melts at a specified temperature to allow doors 14 and 12 to automatically close in the presence of an extraordinary amount of heat, such as caused by a fire.

Figure 8:
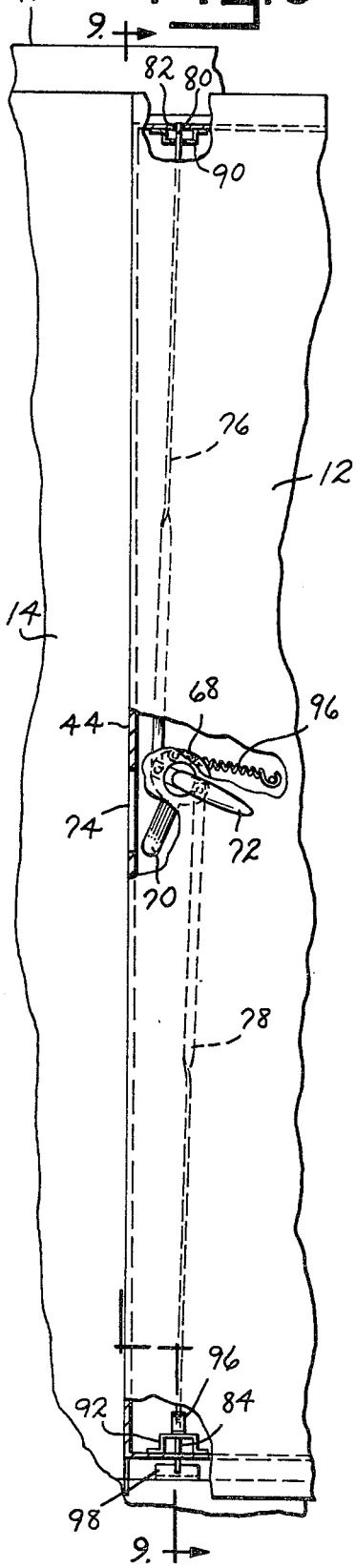
FIG. 8 is a fragmentary front view of the cabinet as seen from line 8—8 of FIG. 7 showing the three-point latching system just before the final door is closed and the latch actuated to secure the door.
Figure 9:
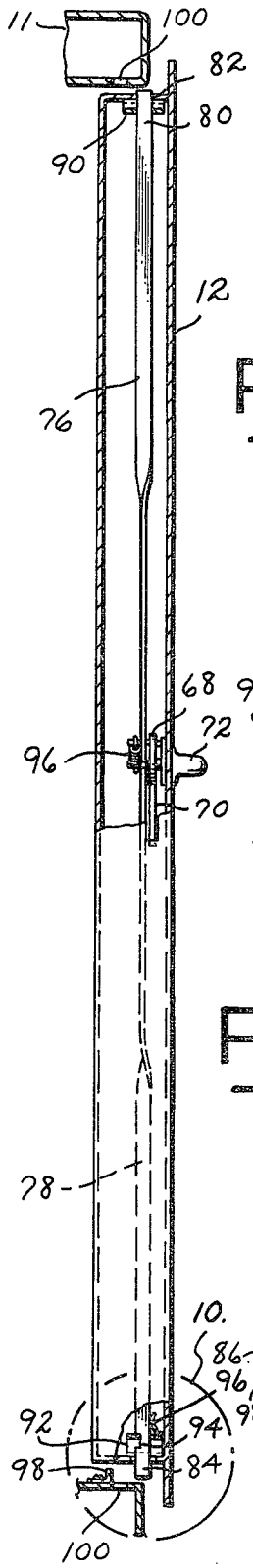
FIG. 9 is a sectional view taken along line 9—9 of FIG. 8.
Figure 12:
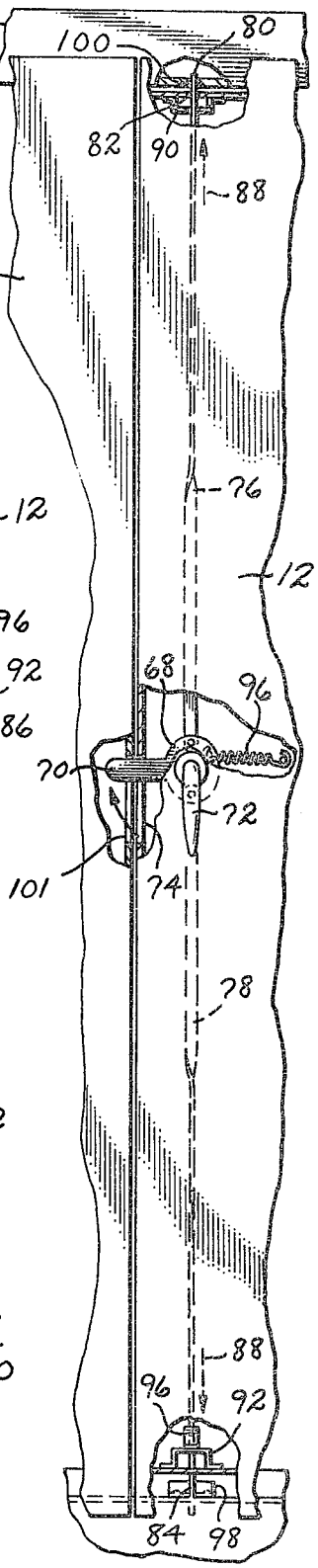
FIG. 12 is a fragmentary front view of the doors of the cabinet of FIG. 1 showing the doors fully closed and the latch system in its locked position.

FIGS. 8–12 illustrate a latching system for the cabinets 10 shown in the embodiments of FIGS. 1–7 and 13–21. Door 12 is provided with what is commonly called a three-point latching mechanism located internally of the door. The latching mechanism includes a center latch 68 which is pivotally connected to door 12 near its vertical center and adjacent edge 44 of the door. Latch 68 includes securement tongue 70 and an exteriorally positioned handle 72. Rotation of handle 72 serves to rotate the latch and pivot tongue 70 between a position inside of door 12 as shown in FIG. 8 and a protruding position extending through an opening 74 in the edge 44 of the door as shown in FIG. 12. A pair of vertically oriented rods 76 and 78 are each connected to latch 68 and form a part of the latch mechanism for door 12. Rod 76 is connected at one end to latch 68 at a location radially spaced from the pivot axis of the latch and approximtely 90 degrees from tongue 70. The opposite end 80 of rod 76 protrudes into an opening 82 in the top edge of door 12. Rod 78 is connected at one end to latch 68 at a location radially spaced from the pivot axis of the latch and diametrically opposed to the connection location of rod 76. Like rod 76, rod 78 is also displaced approximately 90 degrees from tongue 70. The opposite end 84 of rod 78 protrudes into an opening 86 at the bottom edge of door 12. Upon rotation of latch 68 by the turning of handle 72, rods 76 and 78 are shifted generally vertically as indicated by broken line arrows 88 in FIG. 12 between retracted positions as shown in FIG. 9 and extended positions as shown in FIG. 12. A guide bracket 90 is mounted over opening 82 and a guide bracket 92 is mounted over opening 86 in door 12. Rods 76 and 78 extend with slight clearance through suitable openings in each of the guide brackets 90 and 92.

A notch 94 is found in rod 78 near its end 84. A leaf type spring 96 is mounted to bracket 92 and is located at the opposite side of rod 78 from notch 94. Spring 96 continually urges rod 78 against bracket 92 where the rod protrudes through the bracket opening. Notch 94 is located so that as latch 68 is rotated to withdraw or to retract rods 76 and 78 the notch will enter the opening in guide bracket 92 with the notch being urged over the opening edge of bracket 92.

Figure 10:
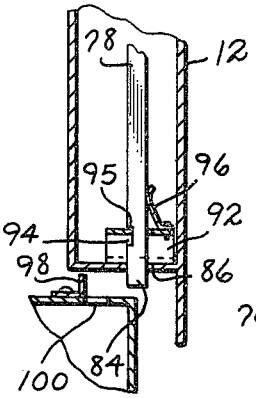
FIG. 10 is an enlarged view of that portion of FIG. 9 encircled by broken line 10.
Figure 11:
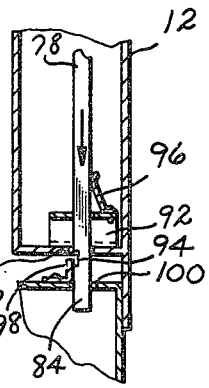
FIG. 11 is a fragmentary view of that portion of the latch system shown in FIG. 10 but with the latch in its locked position and the doors of the cabinet fully closed.

A helical spring 96 has one end connected to latch 68 at a location radially spaced from the pivot axis of the latch. The opposite end of spring 96 is secured to the interior of door 12 with the spring serving to normally urge the latch into its locking position shown in FIG. 12 with tongue 70 protruding from edge 44 of the door. When latch 68 is rotated counterclockwise as viewed in FIGS. 8 and 12 into its opening position shown in FIG. 8, notch 94 will be urged over the opening edge in bracket 92. As latch handle 72 is released, the upper edge 95 of notch 94 will be caused to rest upon bracket 92 as seen in FIG. 10 to secure rods 76 and 78 in their retracted positions with spring 96 remaining in tension.

An upturned flange 98 is located at the lower edge of the door opening into housing 11. Flange 98 is aligned so as to contact protruding end 84 of rod 78 when the rod is in its retracted position and the door is being closed as seen in FIG. 9. An opening 100 is formed in each of the upper and lower edges of the door opening in housing 11 to accommodate ends 80 and 84 of rods 76 and 78. Opening 100 at the lower edge of the door opening into housing 11 is located just forwardly of flange 98. As door 12 is being drawn into its closed position by its closure 20 with latch 68 rotated into its opening position and rods 76 and 78 secured in their retracted positions, protruding end 84 of rod 78 will contact flange 98 and be urged forwardly toward the outer wall of door 12 relative to bracket 92 and out of locking engagement with the bracket. As notch 94 is freed from bracket 92, latch 68 will rotate under the influence of spring 96 to shift rods 76 and 78 into their extended positions with their ends 80 and 84 extending respectively through openings 100 in cabinet housing 11, thereby securing door 12 in its closed position to housing 11.

Through the operation of the previously described prop 32 of the embodiment of the cabinet shown in FIGS. 1–7 or bar 46 desribed with the embodiment of the cabinet shown in FIGS. 13–22, door 14 will precede door 12 in closing. An opening 101 is provided in edge 19 of door 14. As latch 68 is rotated under the influence of spring 96 from its opening position shown in FIG. 8 into its locking position shown in FIG. 12, tongue 70 will enter opening 101 in door 14. In this manner both doors 12 and 14 will be automatically secured in their closed positions. If it is desired to open cabinet 10, handle 72 need only be rotated counterclockwise, causing rods 76 and 78 to be retracted and withdrawn from openings 100 in cabinet housing 11 and tongue 70 to be disengaged from opening 101 in door 14. At the same time spring 96 will cause the notched portion of rod 78 to be urged over bracket 92 which will serve to retain latch 68 in its opening position once handle 72 is released.

In FIGS. 23 and 24 the three-point latching mechanism, which includes a center latch 68, vertically oriented rods 76 and 78, guide brackets 90 and 92, and flange 98, is shown incorporated into a cabinet 102. Cabinet 102 is of a construction like that illustrated in U.S. Pat. No. 3,403,954 which is incorporated herein by reference.

Cabinet 102 includes a housing 104 to which is connected a pair of folding doors 106 and 108. Door 106 is hinged at one side edge to cabinet housing 104 and at its other side edge to one side edge of door 108. Door 108 is connected near its other side edge by a roller to a guide rail across the top of the opening into housing 104. Doors 106, 108 are shiftable between the open position illustrated in FIG. 23 and the closed position illustrated in FIG. 24. A spring mechanism is associated with the hinge connection between doors 106 and 108 for the purpose of normally urging the doors into their closed position. Doors 106, 108 will be secured in their open position during accessible use of the cabinet by means of a suitable fusable link. A more complete description of the construction and manner of operation of cabinet 102 is found in U.S. Pat. No. 3,403,954.

Latch 68 of the latching mechanism is pivotally connected to door 108 adjacent its hinged edge and includes an exteriorly positioned handle 72. Rods 76 and 78 are each connected to latch 68 with the rods protruding through accommodating openings in the top and bottom of door 108. Guide brackets 90 and 92 are mounted over the openings in door 108 with the rods extending with slight clearance through the guide brackets. Leaf type spring 96 is mounted to bracket 92 and contacts rod 78 to continually urge the rod against bracket 92. When latch 68 is rotated to retract rods 76 and 78, notch 94 in rod 78 will enter the opening in guide bracket 92, with the notch being urged by spring 96 over the opening edge of the bracket to secure the latch mechanism in its opening position. Helical spring 95 is connected between latch 68 and door 108 to normally urge the latch mechanism into its locking position with tongue 70 protruding from the hinged edge of the door 108 and the ends of rods 76 and 78 protruding from the upper and lower edges of the door. Flange 98 is located at the lower edge of the door opening into housing 104 of cabinet 102. The manner of operation of the latch mechanism for cabinet 102 is like that previously described for cabinet 10 in that as doors 106,108 are urged into their closed position with rods 76, 78 in their retracted position, rod 76 at its slightly protruding lower end will contact flange 98 so as to be urged out of locking engagement with bracket 92 to allow spring 95 to rotate latch 68 causing rods 76,78 to enter accommodating openings 110 in cabinet housing 104. Simultaneously, tongue 70 of latch 68 will enter an accommodating edge opening 112 in hinged door 106. In this manner, doors 106,108 of cabinet 102 will be secured in their closed position.

It is to be understood that the invention is not to be limited to the details above given, but may be modified within the scope of the appended claims.

What I claim is:

1. A door construction comprising a frame having upper and lower and spaced side parts, a pair of doors supported by said frame, one of said doors hinged at one side edge to said frame, the other of said doors hinged at one side edge to said frame, first and second generally vertically oriented rods carried by said one door adjacent the other side edge of the door, guide means for said rods wherein said first rod is shiftable generally axially relative to said one door between an extended position with one end protruding from the top of the door and a retracted position wherein said second rod is shiftable relative to said one door between an extended position with one end protruding from the bottom of the door and a retracted position, latch means carried by said one door, means connecting the other end of each rod to said latch means for movement of the rods between their respective extended and retracted positions upon rotation of the latch means, said latch means having an opening position in which said rods are in their retracted positions and a locking position in which said rods are in their extended positions, said latch means including retainer means engageable with the other of said doors when said doors are each in a closed position and said latch means is in its locking position, biasing means associated with said latch means for urging the latch means into its locking position, a socket in each of said frame upper and lower parts, said rod one ends protruding lockingly into said sockets when said latch means is in its locking position, catch means carried by said one door for engaging one of said rods when said latch means is rotated into its opening position to releasably secure the latch means in its opening position and the rods in their retracted positions, said frame including trip means for contacting said one rod and disengaging said one rod from said catch means when said one door is closed with said latch means in its opening position whereby said biasing means will urge the latch means into its locking position and cause said rod one ends to enter said frame sockets and said retainer means to engage said other door in its closed position, closure means associated with each door for normally urging each door into its closed position, shiftable prop means associated with said one door for maintaining said one door in a partly closed position until the other door is in its closed position, said prop means including a bar member, means connecting said bar member to either said upper or lower frame parts for longitudinal movement relative to the frame into a first position wherein one end of said bar member is shifted toward one frame side part and a second position relative to the frame wherein the other end of said bar member is shifted toward the other frame side part, spring means connected between said bar member and frame for urging said bar member into its first position, said bar member one end including a projection part which contacts said one door and maintains said one door in its partly closed position when said bar member is in its first position, said bar member other end including a protruding camming means contacted by the other door when said other door is closed for urging said bar member into its second position to permit said one door to close.

2. The door construction of claim 1 wherein said catch means includes a shoulder part means, said one rod having a notch therein located adjacent its said one end, biasing means carried by said one door in contact with said one rod for urging said notched one end of the rod into contact with said shoulder part means, said shoulder part means for supporting said one rod in its retracted position at said notch when said latch means is in its opening position, said trip means for shifting said notched rod one end from supporting contact with said shoulder part means.

3. The door construction of claim 2 wherein said notched rod one end protrudes from said one door when in its retracted position to engage said trip means.

4. The door construction of claim 1 and releasable means for individually securing each door in an open position.

5. The door construction of claim 4 wherein each releasable means is a fusible link secured between each door and one of said frame or closure means associated with the door.

6. A door construction comprising a frame having upper and lower and spaced side parts, a pair of doors, each door hinged at one side edge to a frame side part, closure means associated with each door for normally urging said door into a closed position, shiftable prop means associated with one door for maintaining said one door in a partly closed position until the other door is in its closed position, said prop means including a bar member, means connecting said bar member to either said upper or lower frame parts for longitudinal movement relative to the frame between a first position wherein one end of said bar member is shifted toward one frame side part and a second position wherein the other end of said bar member is shifted toward the other frame side part, spring means for urging said bar member into its first position, said bar member one end including a projection part which contacts said one door to maintain said one door in its partly closed position when said bar member is in its first position, said bar member other end including protruding camming means contacted by said other door when said other door is closing for urging said bar member into its second position to release said one door for closing.

* * * * *